US006673444B2

(12) United States Patent
Yuuki et al.

(10) Patent No.: US 6,673,444 B2
(45) Date of Patent: Jan. 6, 2004

(54) MONOFILAMENT YARN AND PROCESS FOR PRODUCING THE SAME

(75) Inventors: Yasunori Yuuki, Kawanishi (JP); Teruhiko Matsuo, Nobeoka (JP); Tadashi Koyanagi, Nobeoka (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 10/239,416

(22) PCT Filed: Mar. 28, 2001

(86) PCT No.: PCT/JP01/02599

§ 371 (c)(1),
(2), (4) Date: Sep. 24, 2002

(87) PCT Pub. No.: WO01/75200

PCT Pub. Date: Oct. 11, 2001

(65) Prior Publication Data

US 2003/0044607 A1 Mar. 6, 2003

(30) Foreign Application Priority Data

Mar. 30, 2000 (JP) ..... 2000-93724
May 23, 2000 (JP) ..... 2000-151868

(51) Int. Cl.[7] ..... D01F 6/00; D01F 6/92; D01F 6/62

(52) U.S. Cl. ..... 428/364; 428/395; 264/130; 264/210.3; 264/211.14

(58) Field of Search ..... 428/364, 395; 264/130, 210.3, 211.14

(56) References Cited

U.S. PATENT DOCUMENTS

| | | | | |
|---|---|---|---|---|
| 5,645,782 | A | 7/1997 | Howell et al. | 264/103 |
| 6,284,370 | B1 * | 9/2001 | Fujimoto et al. | 428/364 |
| 6,333,106 | B2 * | 12/2001 | Howell et al. | 428/364 |
| 6,423,407 | B1 * | 7/2002 | Abe et al. | 428/364 |
| 6,495,254 | B1 * | 12/2002 | Abe et al. | 428/364 |
| 6,572,967 | B1 * | 6/2003 | Abe et al. | 428/364 |

FOREIGN PATENT DOCUMENTS

| | | |
|---|---|---|
| JP | 8-173244 | 7/1996 |
| WO | WO 99/05936 | 2/1999 |

* cited by examiner

*Primary Examiner*—N. Edwards
(74) *Attorney, Agent, or Firm*—Finnegan, Henderson, Farabow, Garrett, & Dunner, L.L.P.

(57) ABSTRACT

The present invention provides a polytrimethylene terephthalate monofilament yarn excellent in softness, bending recovery or durability against a long term use. The inventive polytrimethylene terephthalate monofilament yarn is constituted by trimethylene terephthalate composed of 90 mol % or more of trymethylene terephthalate repeating units and 10 mol % or less of other ester repeating units, wherein the yarn has a single-fiber size of 50 dtex or more, an intrinsic viscosity in a range from 0.8 to 1.3 dl/g, and a boiling water shrinkage of 2% or less.

7 Claims, 1 Drawing Sheet

MONOFILAMENT YARN AND PROCESS FOR PRODUCING THE SAME

TECHNICAL FIELD

The present invention relates to polytrimethylene terephthalate (hereinafter referred to as PTT) monofilament yarn, a method for producing the same, and brushes using the monofilament yarn.

BACKGROUND ART

In the prior art, monofilaments prepared from thermoplastic resins such as nylon or others have been widely used as raw material for bristles of tooth brushes, cosmetic brushes, hair brushes or various industrial brushes. For example, nylon 612 has been often used as bristles of tooth brushes because it is soft in touch during use to hardly hurt teeth or gums and has a relatively favorable elastic recovery. Nylon, however, is high in moisture absorption and if it absorbs moisture, physical properties and elastic recovery thereof are lowered and the dimension thereof largely changes, whereby there is a problem in that if the brushes are continuously used for a long time, bristles are opened from each other to lower the durability. Also, there is another problem in that the material cost is expensive.

A PTT fiber has been known for a long time, and a multifilament yarn for clothing is disclosed in Japanese Unexamined Patent Publication No. 52-5320 or 58-104216. Also, PTT monofilament yarns are described in (A) Japanese Unexamined Patent Publication No. 5-262862, (B) No. 8-120521 or (C) No. 11-48631, and tooth brushes using the PTT monofilament yarn are disclosed in (D) Japanese Unexamined Publication No. 8-173244 or (E) a published pamphlet WO99/05936.

In the above document (A), a PTT monofilament yarn suitable for a gut of a tennis racket is described, and in Example 5 thereof, the PTT monofilament yarn for a tennis racket gut having an intrinsic viscosity of 1.05 dl/g and a fiber size of 657 denier (730 dtex) is disclosed.

In the document (B), a PTT monofilament yarn suitable for a paper-making canvas is disclosed. It is described in the document (B) that the PTT monofilament yarn disclosed in the document (B) is characterized by a low concentration of terminal carboxyl groups whereby it is high in resistance to hydrolysis (resistance to wet heat). In Example 1, a PTT monofilament yarn is described, having an intrinsic viscosity of 0.95 dl/g and a diameter of 0.4 mm (a fiber size of 1716 dtex).

In the document (C), a gauze for a printing screen using PTT monofilament yarns is disclosed. It is described in the document (C) that the PTT monofilament yarn of a gauze for a printing screen preferably has a fiber size in a range from 8 to 55 dtex (from 7 to 50 denier). In Example 1 thereof, a PTT monofilament yarn is described, having an intrinsic viscosity of 0.89 dl/g, a fiber size of 17 dtex and an elongation at break of 45%.

However, there is neither description nor suggestion in any of the documents (A), (B) and (C) regarding the suitability of the PTT monofilament yarn for brush bristles.

The documents (D) and (E) disclose a brush using PTT monofilament yarn. In an Example of the document (E), the PTT monofilament yarn suitable for tooth brush is described, having a diameter of 0.175 mm (a fiber size of approximately 325 dtex) and a diameter of 0.208 mm (a fiber size of approximately 460 dtex). According to the present inventors, however, it was found that a tooth brush satisfactory in bending recovery and a dimensional stability is not obtainable by the mere application of the PTT monofilament yarn.

In the document (D), there is a description in that an intrinsic viscosity of the PTT monofilament yarn is preferably 0.5 dl/g or more, and in Example 1 thereof, a tooth brush is described which is obtained by filling a PTT monofilament yarn having a diameter of 0.22 mm (a fiber size of approximately 515 dtex) produced from PTT resin having an intrinsic viscosity of 0.70 dl/g, which is spun, cooled and heat-drawn, and thereafter subjected to a constant-length heat set at 140° C. for 10 minutes. As the PTT monofilament yarn obtained under such conditions is low in intrinsic viscosity (in other words, low in degree of polymerization), it is also low in toughness and in elastic recovery. Therefore, when used as a brush bristle, splits, wear or opening due to the fatigue of bristle might occur within a short period.

Also, according to Example described in the document (D), the residual heat shrinkage is high because of unsuitable heat-setting conditions after the drawing process. Thereby, during a filling process for tooth brushes, the standing upright (the straightening) of the brush bristles becomes worse due to heat generated when the bristles are trimmed (to align tips thereof) or end-rounded (to round tips thereof), resulting in the bend of bristles or the opening of bristles. Further, due to the heat treatment after the brush has been completed, such as a high-temperature sterilizing treatment, deformation, kink or opening of the bristle may occur, whereby this yarn is unsatisfactory as brush bristles.

DISCLOSURE OF THE INVENTION

An object of the present invention is to provide a monofilament yarn excellent in softness, bending recovery or durability against a long term use, and a method for producing the same.

That is, the present invention is as follows:

1. A PTT monofilament yarn constituted by PTT composed of 90 mol % or more of trimethylene terephthalate repeating units and 10 mol % or less of other ester repeating units, wherein the yarn has a single-fiber size of 50 dtex or more, an intrinsic viscosity in a range from 0.8 to 1.3 dl/g, and a boiling water shrinkage of 2% or less.
2. A PTT monofilament yarn as defined by the above item 1, wherein the boiling water shrinkage is in a range from 0 to 1.5%.
3. A PTT monofilament yarn as defined by the above item 1 or 2, wherein a peak temperature of a mechanical loss tangent is in a range from 100 to 120° C.
4. A PTT monofilament yarn as defined by any one of the above items 1 to 3, wherein the yarn contains particles, in a range from 0.01 to 5 wt %, which have an average diameter in a range from 0.01 to 5 $\mu$m
5. A brush filled with bristles of the PTT monofilament yarn defined by any one of the above items 1 to 4.
6. A method for producing a PTT monofilament yarn, wherein after a raw material PTT monofilament yarn having a fiber size of 50 dtex or more is spun and drawn, the raw material PTT monofilament yarn is subjected to a relaxation heat treatment under the condition of a relaxation ratio in a range from −10 to +15% and a heat treatment temperature in a range from 100 to 180° C.

7. A method for producing a PTT monofilament yarn as defined by the above item 6, wherein the relaxation ratio is in a range from 1 to 15%.

DETAILED DESCRIPTION OF THE INVENTION

Figure 1:
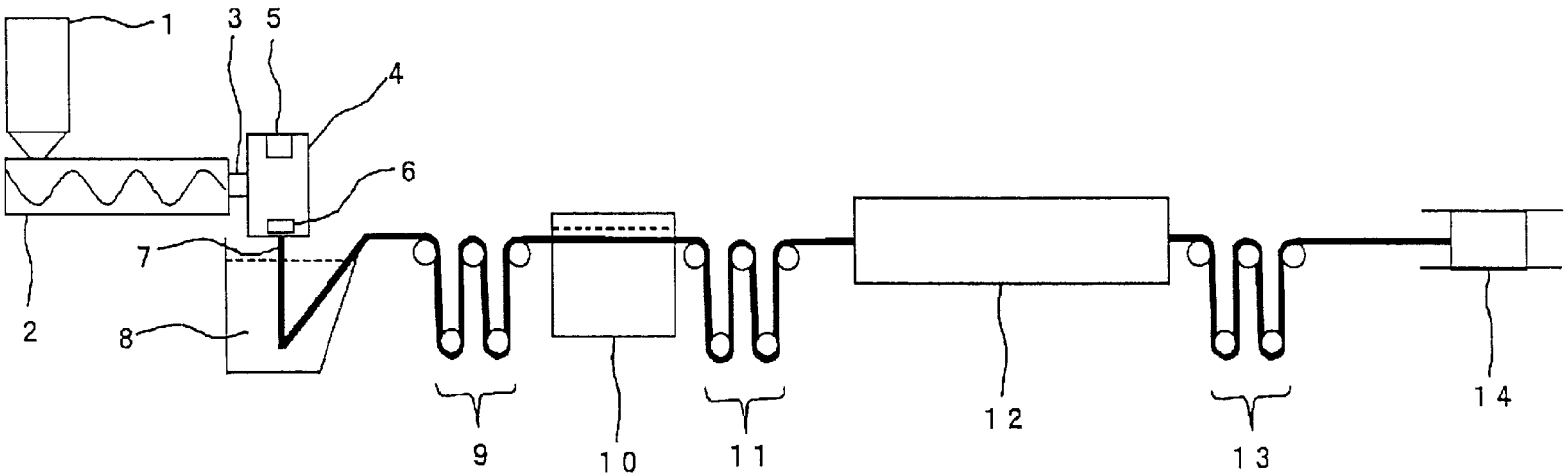
FIG. 1 is a schematic view illustrating a method for producing a PTT monofilament yarn according to the present invention.

The present inventors have diligently studied to achieve the above-mentioned object, and found that a PTT monofilament yarn excellent in softness, bending recovery as well as durability is obtained by properly selecting an intrinsic viscosity of PTT resin and carrying out heat treatment, after drawing an undrawn yarn, under a specified condition, to have a heat shrinkage within a certain range. Thus, the present invention has been made.

The monofilament yarn of the present invention is applicable to various uses. Of them, it is suitable for a brush bristle because it has at least one feature in that the processability and the standing upright are favorable when the brush is made therefrom, the sense of use is soft, no opening occurs due to the fatigue of bristle even after the long term use, and the shape stability is excellent when heat-treated.

The present invention will be described below in more detail.

The PTT monofilament yarn according to the present invention has a single-fiber size of 50 dtex or more. The PTT monofilament yarn is characterized in that it is very soft because of low Young's modulus thereof and excellent in elastic recovery. If the single-fiber size is 50 dtex or more, both of the strength and the bending recovery are sufficiently large to satisfy the required performance in the aimed use. The single-fiber size is preferably 56 dtex or more, more preferably in a range from 100 to 80000 dtex, and may be suitably selected in accordance with use.

In the present invention, PTT refers to a polyester mainly composed of 90 mol % or more of trimethylene terephthalate repeating units. Accordingly, it includes PTT containing, as a third component, 10 mol % or less of another acid component and/or a glycol component.

PTT is synthesized by the polycondensation of terephthalic acid or a functional derivative of terephthalic acid such as dimethyl terephthalate with trimethylene glycol or functional derivative thereof in the presence of a catalyst under a suitable reactive condition. In this synthesis process, one or more third components may be added thereto to result in a copolymerized polyester. A polyester other than PTT, such as polyethylene terephthalate (hereinafter referred to as PET), or nylon may be blended with PTT or spun together with PTT as a composite fiber (having a cross-sectional shape of a sheath/core type or a side-by-side type).

Regarding the composite spinning, as disclosed in Japanese Unexamined Patent Publication (Kokai) Nos. 43-19108, 11-189923, 2000-239927 and 2000-256918, a side-by-side type or an eccentric sheath/core type has been known, in which PTT used as a first component and PTT, polyester such as PET or polybutylene terephthalate or nylon used as a second component are arranged in a side-by-side manner or in an eccentric manner. Particularly, the combination of PTT and PTT copolymer or the combination of two kinds of PTT having different intrinsic viscosity values are favorable. Of them, as disclosed in Japanese Unexamined Patent Publication No. 2000-239927, a side-by-side type composite yarn composed of two kinds of PTT having different intrinsic viscosity values arranged so that the lower viscosity one encompasses the higher viscosity one to have a curved boundary surface is particularly preferable because it has both a high stretchability it and a high bulkiness.

In this regard, as the composite yarn in which two kinds of different polymers are arranged in a side-by-side manner or an eccentric manner may spontaneously develop coil crimps, such a composite yarn is suitably used in applications or fields in which the straightening of the monofilament yarn is not required.

As a third component to be contained in PTT includes aliphatic dicarboxylic acid (oxalic acid, adipic acid or others), alicyclic dicarboxylic acid (cyclohexane dicarboxylic acid or others), aromatic dicarboxylic acid (isophthalic acid, sodiumsulfoisophthalic acid or others), aliphatic glycol (ethylene glycol, 1,2-propylene glycol, tetramethylene glycol or others), alicyclic glycol (cyclohexane dimethanol or others), aliphatic glycol containing aromatic groups (1,4-bis (β-hydroxyethoxy) benzene or others), polyether glycol (polyethylene glycol, polypropylene glycol or others), aliphatic oxycarboxylic acid (ω-oxycapronic acid or others), and aromatic oxycarboxylic acid (p-oxybenzoic acid or others). Also, compounds having 1 or 3 or more of ester-forming functional groups (such as benzoic acid or glycerin) may be used, provided the resultant polymer is substantially linear.

The PTT monofilament yarn may be added with modification additives, for example, a delusterant such as titanium oxide, a stabilizer such as phosphoric acid, an ultraviolet absorber such as hydroxybenzophenone derivative, a crystallizing nucleus such as talc, a lubricant such as aerozil, an antioxidant such as a hindered phenol derivative, an antifungus agent, a flame retardant, an antistatic agent, a pigment, a fluorescent whitener, an infrared absorber or a defoamer.

As smoothness is required during the process for producing monofilament yarn, the PTT monofilament yarn of the present invention contains particles having an average diameter in a range from 0.01 to 5 μm, preferably from 0.01 to 2 μm at a ratio in a range from 0.01 to 5 wt %. If particles having an average diameter in a range from 0.01 to 5 μm are contained at a ratio in a range from 0.01 to 5 wt %, a PTT monofilament yarn rich in smoothness, excellent in spinnability as well high in strength is obtainable.

The contained particles are preferably of titanium oxide or pigment. For example, in the application in which a whiteness of brush bristle is required such as a tooth brush, titanium oxide is preferably contained at a ratio in a range from 0.50 to 5 wt %. As the PTT monofilament yarn has a higher degree of transparency than PET monofilament yarn, slightly more titanium oxide is preferably added to the PTT monofilament yarn to achieve the same degree of whiteness as that of PET monofilament yarn. While colored monofilament yarns may be obtained by dyeing the monofilament yarn after being spun, in the application to a tooth brush or others, a colored polymer containing pigment is preferably spun to be the monofilament yarn.

An intrinsic viscosity of the PTT monofilament yarn is in a range from 0.8 to 1.3 dl/g, preferably from 0.8 to 1.1 dl/g. If the intrinsic viscosity is 0.8 dl/g or more, the resultant PTT monofilament yarn is high in toughness and elastic recovery, whereby if used as a brush bristle, splits, wear or opening of the brush bristles do not occur even after being used for a long time. Also, if the intrinsic viscosity is 1.3 dl/g or less, there is no bend of the monofilament yarn during the heat treatment process, whereby, when used as a brush bristle, the straightening thereof can be maintained to facilitate the production of the brush. That is, by maintaining the intrinsic viscosity in a range from 0.8 to 1.3 dl/g, it is possible to obtain a PTT monofilament yarn excellent in straightening, toughness and bending recovery.

In this regard, the intrinsic viscosity [η] is calculated by the following equation based on a ratio (ηsp/C) of a specific viscosity ηsp relative to a concentration C (g/100 ml) measured by using o-chlorophenol at 35° C. via an Ostwald viscosity tube, which ratio is extrapolated to the concentration zero:

$$[\eta]=\lim_{C\to 0}(\eta sp/C)$$

The PTT monofilament yarn according to the present invention has a boiling water shrinkage of 2% or less, preferably lower than 2%, more preferably in a range from 0 to 1.5%. While the PTT monofilament yarn is superior to nylon monofilament yarn or PET monofilament yarn in elastic recovery of elongation, it is characterized to have a high heat shrinkage. If the boiling water shrinkage is 2% or less, the heat shrinkage of yarn is small during the processing or use of a product such as a brush, whereby the dimensional change, deformation or kink of the monofilament yarn hardly occurs. For example, during the process for producing a tooth brush, in general, after a bundle of the monofilament yarns, cut to have a predetermined length, is pushed in a hole opened in a handle of a tooth brush, the trimming (uniformly arranging tip ends of bristles) and the end-rounding (rounding the tip ends of bristles) are carried out. At that time, heat is generated because the tip ends of the bristles are abraded with a whetstone rotating at a high speed. Even in such a case, if the boiling water shrinkage is 2% or less, no deformation, kink or opening of the brush bristles occurs due to heat thus generated, and the standing upright (the straightening) of the brush bristle is not impaired.

Further, in the fields in which the monofilament yarn is used (such as a brush bristle or a connecting yarn for a three-dimensional fabric), a high bending recovery is often required. According to the study made by the present inventors, it was found that the smaller the heat shrinkage, the more the bending recovery. By controlling the boiling water shrinkage to 2% or less, the PTT monofilament yarn having a high bending recovery is obtainable, and if it is applied to brush bristles, they are extremely excellent in resistance to opening even after a long term use.

To control the boiling water shrinkage within a proper range, the PTT monofilament yarn is heat-treated under the suitable condition after being spun and drawn. While the heat treatment may be carried out consecutively to the spinning and drawing, the PTT monofilament yarn is preferably heat-treated after it is wound as a package.

As far as the boiling water shrinkage is within a range defined by the present invention, the heat treatment may be either of a relaxation system, a constant-length system or a stretching system. Preferably, it is carried out at a relaxation ratio calculated by the following equation in a range from −10 to +15%.

$$\text{Relaxation ratio } (\%)=\{(L0-L1)/L0\}\times 100$$

wherein L0 is a length of a monofilament yarn prior to being heat-treated and L1 is a length of a monofilament yarn restrained during the heat treatment.

The relaxation heat treatment is one carried out at a relaxation ratio larger than 0% under the condition so that the monofilament yarn is freely shrinkable or restricted to be shrinkable at a predetermined ratio relative to the yarn length prior to the heat treatment. The PTT monofilament yarn is preferably subjected to the relaxation heat treatment at the relaxation ratio equal to or somewhat smaller than the heat shrinkage at the heat treatment temperature because the monofilament yarn is straight after the heat treatment. Concretely, the relaxation ratio is preferably in a range from 1 to 15%, more preferably from 5 to 12%. If the relaxation ratio exceeds 15%, that is, the monofilament yarn is in a slack state, even after the heat treatment, the straightening of the monofilament yarn is liable to be deteriorated.

A constant-length heat treatment is one carried out at the relaxation ratio of 0% while preventing the length of monofilament yarn changing between before and after the heat treatment. A stretching heat treatment is one carried out at a relaxation ratio smaller than 0%; that is, the monofilament yarn is heat-treated in a stretched state at a predetermined ratio relative to a length prior to the heat treatment. When the PTT monofilament yarn is subjected to the constant-length heat treatment or the stretching heat treatment, the relaxation ratio is preferably in a range from −10 to 0%. In this regard, a high temperature is necessary to obtain the boiling water shrinkage of 2% or less in the constant-length heat treatment or the stretching heat treatment. However, an excessively high temperature may cause yarn breakage or the lowering of yarn strength during the heat treatment.

The heat treatment temperature of the PTT monofilament yarn is preferably in a range from 100 to 180° C., more preferably from 120 to 160° C. As it is possible to lower the boiling water shrinkage to 2% or less without the heat treatment in an over-slack state if the heat treatment temperature is 100° C. or higher, the straightening of the monofilament yarn is not injured. On the other hand, if the heat treatment temperature is 180° C. or lower, no yarn breakage occurs during the heat treatment and the yarn strength does not lower.

A heat treatment time may be suitably selected in accordance with a bundle state of the monofilament yarn to be heat-treated. For example, when a hank-shaped bundle of approximately 200 to 400 PTT monofilament yarns, each having a diameter of 0.2 mm (a fiber size of approximately 430 dtex), is heat-treated, the heat treatment time is preferably 20 minutes or more, more preferably 30 minutes or more, for the purpose of heat-treating sufficiently the monofilament inner part of the kank. If the heat treatment time is too short, it is difficult to lower the boiling water shrinkage to 2% or less, and a heat-set irregularity occurs between the respective monofilament yarns and/or in the longitudinal direction thereof, resulting in the irregularity of heat shrinkage. Accordingly, when the yarn is used for a brush bristle, heat applied thereto during the production of a brush or the high-temperature sterilizing treatment of the brush may cause the deformation or kink of bristle or the opening of bristles.

On the other hand, when the PTT monofilament drawn yarns are continuously heat-treated in a loose state while not forming a bundle in which they are in tight contact with each other, the heat treatment time becomes short provided the requirement of the present invention is satisfied, for example, one minute or less, because heat is easily transferred to the individual monofilament yarns.

The PTT monofilament yarn according to the present invention has a peak temperature of a mechanical loss tangent (hereinafter referred to as Tmax) obtained by the measurement of a dynamic viscoelasticity preferably in a range from 100 to 120° C., more preferably from 105 to 114° C. To control the Tmax within this range, the PTT monofilament yarn is heat-treated under a suitable condition after being spun and drawn, for example. If the Tmax is within this range, the boiling water shrinkage is 2% or less, whereby a monofilament yarn, excellent in bending recovery and in straightening, is obtainable.

The PTT monofilament yarn according to the present invention preferably has the degree of crystalline orientation in a range from 90 to 95%. The degree of crystalline orientation of 95% is the maximum value achievable by the PTT monofilament yarn, and a range from 90 to 95% is effective for obtaining a PTT monofilament yarn excellent in toughness and/or bending recovery.

The PTT monofilament yarn according to the present invention preferably has an elongation at break in a range from 35 to 65%, more preferably from 35 to 55%. If the elongation at break is within this range, the monofilament yarn is tough and free from splitting of the brush bristle when used for a long time, and also no thickness irregularity exists in the longitudinal direction of the monofilament yarn, to improve the product value.

The PTT monofilament yarn according to the present invention preferably has a strength at break of 2.2 cN/dtex or more. If the strength at break is 2.2 cN/dtex or more, the strength is large enough to prevent the brush bristle from splitting or wearing even after being used for a long time.

A fiber size of the PTT monofilament yarn according to the present invention may be suitably selected in accordance with uses of the monofilament yarn. For example, when used as a tooth brush, it is preferably in a range from 200 to 600 dtex, more preferably from 250 to 550 dtex. If the fiber size is within this range, the contamination on teeth is sufficiently removable without damaging the gums because the hardness of the tooth brush is suitable, and no bristle is caught in a gap between the teeth.

When the PTT monofilament yarn according to the present invention is used as a connecting yarn for coupling front and back knit layers of a three-dimensional knit fabric with each other, the fiber size is preferably in a range from 50 to 1200 dtex, more preferably 560 dtex or less, furthermore preferably 280 dtex or less.

When the PTT monofilament yarn according to the present invention is used as a gut for a tennis or badminton racket, the fiber size is preferably in a range from 7000 to 22000 dtex. When it is used as a musical instrument such as a string for a guitar, the fiber size is preferably in a range from 2000 to 14000 dtex, and, as a chair cloth, is preferably from 50 to 2500 dtex.

Also, the PTT monofilament yarn according to the present invention may be a plied yarn or a twisted yarn of a plurality of single yarns.

The PTT monofilament yarn according to the present invention may be uniform or uneven in thickness in the longitudinal direction or imparted with crimps. A cross-section of the yarn may be of various shape such as a circle, a triangle, an L-shape, a T-shape, a Y-shape, a W-shape, an octalobal shape, a flat shape or a dog-bone shape in which a polygonal shape, a multilobal shape, a hollow shape, or even an indefinite shape may be included.

Also, when used as a brush or others, a free end of the PTT monofilament yarn may be rounded or tapered, or a free end and/or a surface of the yarn may be imparted with craters or micro-indentations. Any methods can be employed for obtaining such a modification of free end or surface of the PTT monofilament yarn. For example, an alkaline weight-reduction may be adopted.

The PTT monofilament yarn according to the present invention may be spun and drawn by a conventional method and, for example, may be as follows:

In FIG. 1, PTT pellets are dried in a dryer 1 and fed to an extruder 2 to become molten PTT. The molten PTT is supplied to a spin head 4 through a bend 3, metered by a gear pump 5 mounted therein, and spun from a spinneret 6. The molten PTT thus spun in a filament form 7 is quenched in a quenching water bath 8 and drafted to a predetermined fiber size by means of a first roll group 9 rotating at a constant speed to be an undrawn monofilament yarn. Then, the undrawn monofilament yarn is stretched in a warm water bath 10 at a predetermined temperature by a second roll group 11 to be subjected to a first drawing. Thereafter, the monofilament yarn is subjected to a constant-length or relaxation heat treatment in a steam bath 12 at a predetermined temperature, and taken up by a winder 14 after passing a third roll group 13.

The drawing in the warm water bath is not limited to a single-step drawing but may be a multi-step drawing. The boiling water shrinkage of the PTT monofilament yarn may be adjustable in accordance with a temperature, a time, a relaxation ratio and/or a stretching ratio during the heat treatment.

The PTT monofilament yarn according to the present invention is preferably imparted with a finishing agent for reducing the frictional resistance or facilitating the antistatic property to improve the process-passing property in a subsequent process. Further, a water repellent or a moisture absorbent may be applied in accordance with the required functions. The finishing agent is preferably applied between the steam bath 12 and the third roll group 13.

While kinds of the finishing agent are not limited, a mixture of finishing agents in which aliphatic ester, mineral oil, polyether, nonionic surfactant and/or ionic surfactant are mixed in a proper ratio is preferably used.

A pick-up of the finishing agent is preferably in a range from 0.01 to 0.3 wt %.

The present invention will be described in more detail below with reference to Examples and Comparative examples. However, the present invention should not be limited to these Examples.

In this regard, the measurements and the evaluation methods are as follows:

(1) Strength at Break, Elongation at Break and Boiling Water Shrinkage

The strength at break, elongation at break and boiling water shrinkage were measured in accordance with JIS-L-1013; a hot water shrinkage B method (the filament shrinkage); and an average value of ten measurements was calculated in the respective items.

(2) Peak Temperature of Mechanical Loss Tangent

A dynamic viscoelasticity measurement device of a Rheovibron DDV-EIIA type manufactured by Toyo Baldwin K.K. was used for depicting a curve of a mechanical loss tangent (tan δ) versus temperature of a test piece of approximately 0.1 mg at the respective temperature in a dry air under the condition in that the measurement frequency is 110 Hz and a temperature increasing rate is 5° C./min. From this curve, a temperature at which tan δ exhibits a peak (Tmax) was determined.

(3) Degree of Crystallinity

By using an x-ray diffraction device, a diffraction intensity curve of a test piece of approximately 0.5 $\mu$m thick was depicted between the diffraction angles of 7 and 35 degrees.

The measurement condition was as follows; 30 kV, 80A, a scanning speed of 1 degree/min, a chart speed of 10 mm/min, a time constant of 1 second and a receiving slit of 0.3 mm.

The reflection depicted at 2θ=16 degrees and 22 degrees were faces (010) and (110), respectively. Further, a diffraction intensity curve was depicted while orientating the face (010) in the orientation angle direction from −180 to +180 degrees. An average value of the diffraction intensity curve obtained at ±180 degrees was obtained, and a horizontal line was drawn to be a base line. A vertical line is drawn from the peak to the base line, and a middle point of the height of the vertical line was determined. A horizontal line passing the middle point was drawn to cross the diffraction intensity curve, and a distance between the two cross points is measured. The distance thus obtained was converted to an orientation angle H.

The degree of crystallinity is given by the following equation:

$$\text{Degree of crystallinity } (\%)=\{(180-H)/180\}\times 100$$

(4) Bending Recovery (Resistance to Opening of Bristles)

The bending recovery was measured in accordance with JIS-S-3016 defining a recovery test of bristle, and an average value of ten measurements was calculated. In this regard, two levels of hot water temperature; 60±2° C. and 35±2° C.; were used for the heat treatment while applying a load.

(5) Standing Upright of Bristle

A tooth brush was manufactured by cutting bristles to a length of 7.00±0.15 mm along a horizontal plane and the standing upright (straightening) of the bristles was observed by naked eyes. Results were evaluated according to the following three criteria:

○: No deformation or kink of the bristles was observed

Δ: Slight deformation and kink of the bristles were observed

X: Significant deformation and kink of the bristles were observed (6) Durability Against Opening Prepared tooth brushes were used by ten judges for one week, and the averaged opening of bristles of the ten tooth brushes were determined in accordance with the following criteria:

○: Opening was hardly observed

Δ: Opening was discernible

X: Significant opening was observed (7) Damage to Bristles

Prepared tooth brushes were used by ten judges for one week, and the averaged damage of bristles of the ten tooth brushes were determined in accordance with the following criteria:

○: No split or wear of bristle tip was observed

Δ: Slight split or wear of bristle was observed

X: Significant split or wear of the bristle was observed (8) Copper Plate Abrasion Test (Possibility of Damaging Teeth and Gums)

Bristles of a prepared tooth brush were brought into contact, at right angles, with a copper plate having a smooth surface under a load of 70 N per unit area ($cm^2$), in the above state, the copper plate surface was scrubbed with the brush for 10 seconds at a stroke length of 1 cm and a stroke speed of 120 st/min. Thereafter, the surface of the copper plate was observed by naked eyes and estimated in accordance with the following five criteria. An average value of ten measurements was calculated:

5: No damage was visible

4: Slight damage was visible at a certain viewing angle

3: Damage was visible at any viewing angle

2: Large damage was clearly visible

1: The surface was significantly damaged (9) Sense of Use

Prepared tooth brushes were used by ten judges for one week, and the sense of use was determined by a sensory test in the following criteria. The evaluation values of the ten judges were averaged.

5: Very soft

4: Slightly soft

3: ordinary

2: Hard

1: very hard

EXAMPLE 1

A raw material PTT monofilament yarn was produced under the following conditions from PTT polymer having an intrinsic viscosity [η] of 0.92 dl/g and containing titanium oxide at 0.1 wt %:

Extrusion rate of polymer: 2.52 g/min

Spinning temperature: 260° C.

Water temperature of quenching bath: 40° C.

Peripheral speed of take-up roll (first roll): 15.8 m/min

Water temperature of drawing bath: 55° C.

Peripheral speed of draw roll (second roll): 79.2 m/min

Steam temperature of heat treatment bath: 120° C.

Peripheral speed of third roll: 72 m/min

Take-up speed: 72 m/min

The PTT monofilament yarn obtained in accordance with the above condition had the following physical properties:

Intrinsic viscosity: 0.90 dl/g

Yarn diameter: 0.18 mm

Fiber size: 355 dtex

Strength at break: 3.0 cN/dtex

Elongation at break: 48.1%

Boiling water shrinkage: 6.4%

The PTT monofilament yarn thus produced was wound to form a hank of 400 ends, which was then heat-treated under the following condition:

Heat treatment temperature: 120° C.

Heat treatment time: 60 min

Relaxation ratio: 5%

The resultant PTT monofilament yarn was supplied to an ordinary process for producing tooth brushes.

Physical properties and bending recovery of the monofilament yarn and the evaluation of the tooth brush thus obtained are shown in Table 1.

EXAMPLES 2 TO 6

PTT monofilament yarn and tooth brushes were obtained in the same manner as in Example 1, except that the heat treatment was carried out under the conditions shown in Table 1. Physical properties and bending recovery of the monofilament yarns and the evaluation of the tooth brushes thus obtained are shown in Table 1.

EXAMPLE 7

A PTT monofilament yarn was produced in the same manner as in Example 1 from PTT polymer having the intrinsic viscosity [η] of 1.13 dl/g, containing titanium oxide of 0.1 wt %, which was then heat-treated under the condition in Example 3 to result in the inventive PTT monofilament yarn. Tooth brushes were produced from the resultant monofilament yarn in the same manner as in Example 1.

Physical properties and bending recovery of the monofilament yarn and the evaluation of the tooth brush thus obtained are shown in Table 1.

EXAMPLES 8 TO 10

Raw material PTT monofilament yarns were produced in the same manner as in Example 1, except that the content of titanium oxide is changed to 0 wt % (Example 8), 3 wt % (Example 9) and 6 wt % (Example 10), respectively, and were then heat-treated under the same condition as in Example 3 to result in the inventive PTT monofilament yarns. The resultant PTT monofilament yarns were supplied to an ordinary process for producing tooth brushes.

Physical properties and bending recovery of the monofilament yarns and the evaluation of the tooth brushes thus obtained are shown in Table 1.

COMPARATIVE EXAMPLES 1 TO 3

PTT monofilament yarns and tooth brushes were obtained in the same manner as in Example 1 except that the heat treatment was carried out under the condition defined in Table 2. Physical properties and bending recovery of the monofilament yarns and the evaluation of the tooth brushes thus obtained are shown in Table 2.

COMPARATIVE EXAMPLE 4

A raw material PTT monofilament yarn was produced from PTT polymer having an intrinsic viscosity [η] of 0.70 dl/g, containing titanium oxide of 0.1 wt % under the same condition as in Example 1, which was then heat-treated under the same conditions as in Example 3 to result in the final PTT monofilament yarn. Tooth brushes were prepared by using the resultant monofilament yarn in the same manner as in Example 1.

Physical properties and bending recovery of the monofilament yarns and the evaluation of the tooth brushes thus obtained are shown in Table 2.

COMPARATIVE EXAMPLE 5

A final PTT monofilament yarn was obtained under the same condition for the production as in Example 1 and the same condition for the heat treatment as in Example 3, except that a fiber size measured after the heat treatment was 44 dtex.

Tooth brushes were prepared from the resultant monofilament yarn in the same manner as in Example 1.

Physical properties and bending recovery of the monofilament yarns and the evaluation of the tooth brushes thus obtained are shown in Table 2.

COMPARATIVE EXAMPLE 6

Tooth brushes were prepared in the same manner as in Example 1 from nylon 612 (hereinafter referred to as N612) monofilament yarn heat-treated under the condition shown in Table 2. Physical properties and bending recovery of the monofilament yarns and the evaluation of the tooth brushes thus obtained are shown in Table 2.

TABLE 1

| | Kind of polymer | Intrinsic viscosity of yarn (dl/g) | Heat treatment: Temperature (° C.) | Heat treatment: Time (min) | Heat treatment: Relaxation ratio (%) | Yarn size (dtex) | Diameter (mm) | Strength at break (cN/dtex) | Elongation at break (%) |
|---|---|---|---|---|---|---|---|---|---|
| Example 1 | PTT | 0.90 | 120 | 60 | 5 | 373 | 0.19 | 2.8 | 54.2 |
| Example 2 | PTT | 0.90 | 140 | 60 | 5 | 375 | 0.19 | 2.6 | 53.1 |
| Example 3 | PTT | 0.90 | 160 | 60 | 10 | 393 | 0.20 | 2.4 | 60.3 |
| Example 4 | PTT | 0.90 | 110 | 60 | 5 | 372 | 0.19 | 2.8 | 53.8 |
| Example 5 | PTT | 0.90 | 160 | 60 | 0 | 358 | 0.18 | 2.9 | 46.5 |
| Example 6 | PTT | 0.90 | 160 | 60 | −2 | 350 | 0.18 | 2.9 | 40.7 |
| Example 7 | PTT | 1.90 | 160 | 60 | 10 | 391 | 0.20 | 3.3 | 50.5 |
| Example 8 | PTT | 0.90 | 160 | 60 | 10 | 396 | 0.20 | 2.5 | 59.2 |
| Example 9 | PTT | 0.90 | 160 | 60 | 10 | 395 | 0.20 | 2.2 | 54.8 |
| Example 10 | PTT | 0.90 | 160 | 60 | 10 | 398 | 0.20 | 2.1 | 51.7 |

| | Boiling water shrinkage (%) | Tmax (° C.) | Degree of crystallinity (%) | Bending recovery (%) 35° C. | Bending recovery (%) 60° C. | Standing upright | Resistant to opening | Damage to yarn | Copper plate abrasion test | Sense of use |
|---|---|---|---|---|---|---|---|---|---|---|
| Example 1 | 1.4 | 119.3 | 93.1 | 77.3 | 38.5 | ○ | ○ | ○ | 4.3 | 4.6 |
| Example 2 | 1.2 | 113.0 | 93.0 | 78.9 | 40.1 | ○ | ○ | ○ | 4.2 | 4.5 |
| Example 3 | 0.6 | 110.0 | 91.9 | 82.7 | 48.3 | ○ | ○ | ○ | 4.1 | 4.3 |
| Example 4 | 1.8 | 119.5 | 93.7 | 76.3 | 38.1 | ○ | ○ | ○ | 4.3 | 4.7 |
| Example 5 | 1.5 | 111.2 | 93.3 | 78.1 | 38.4 | ○ | ○ | ○ | 4.2 | 4.2 |
| Example 6 | 1.7 | 113.4 | 93.8 | 75.9 | 37.9 | ○ | ○ | ○ | 4.1 | 4.1 |
| Example 7 | 0.8 | 112.8 | 92.5 | 83.7 | 47.1 | ○ | ○ | ○ | 4.1 | 4.1 |
| Example 8 | 0.6 | 109.8 | 92.1 | 83.0 | 49.0 | ○ | ○ | ○ | 4.2 | 4.4 |
| Example 9 | 0.5 | 109.4 | 91.4 | 81.6 | 47.9 | ○ | ○ | ○ | 3.9 | 4.1 |
| Example 10 | 0.5 | 109.6 | 91.2 | 80.4 | 43.2 | ○ | ○ | Δ | 3.7 | 3.8 |

TABLE 2

| | Kind of polymer | Intrinsic viscosity of yarn (dl/g) | Heat treatment Temperature (° C.) | Time (min) | Relaxation ratio (%) | Yarn size (dtex) | Diameter (mm) | Strength at break (cN/dtex) | Elongation at break (%) |
|---|---|---|---|---|---|---|---|---|---|
| Comparative example 1 | PTT | 0.90 | 90 | 30 | 3 | 363 | 0.18 | 2.9 | 50.1 |
| Comparative example 2 | PTT | 0.90 | 140 | 10 | 0 | 353 | 0.18 | 2.8 | 46.5 |
| Comparative example 3 | PTT | 0.90 | 190 | 60 | 12 | 396 | 0.20 | 1.9 | 68.4 |
| Comparative example 4 | PTT | 0.67 | 160 | 60 | 10 | 391 | 0.20 | 1.8 | 48.6 |
| Comparative example 5 | PTT | 0.90 | 160 | 60 | 10 | 44 | 0.07 | 2.5 | 57.7 |
| Comparative example 6 | N612 | — | 110 | 60 | 10 | 248 | 0.18 | 3.7 | 28.4 |

| | Boiling water shrinkage (%) | Tmax (° C.) | Degree of crystallinity (%) | Bending recovery (%) 35° C. | 60° C. | Standing upright | Resistant to opening | Damage to yarn | Copper plate abrasion test | Sense of use |
|---|---|---|---|---|---|---|---|---|---|---|
| Comparative example 1 | 3.5 | 121.3 | 93.7 | 63.3 | 28.0 | X | X | ○ | 4.3 | 4.8 |
| Comparative example 2 | 2.2 | 115.1 | 93.3 | 71.7 | 35.2 | X | Δ | ○ | 4.0 | 4.3 |
| Comparative example 3 | 0.3 | 104.5 | 91.2 | 85.4 | 49.2 | ○ | ○ | X | 3.7 | 3.7 |
| Comparative example 4 | 0.5 | 107.0 | 88.2 | 65.2 | 34.3 | ○ | X | X | 4.2 | 4.6 |
| Comparative example 5 | 0.7 | 110.3 | 92.6 | 70.2 | 35.0 | ○ | Δ | Δ | 4.7 | 4.7 |
| Comparative example 6 | 0.5 | — | — | 68.6 | 33.4 | ○ | X | X | 2.6 | 2.8 |

From above, the following have been found:

According to Examples 1 to 10, either of the inventive PTT monofilament yarns have a proper boiling water shrinkage, whereby the resultant tooth brushes were free from the deformation or kink of bristles and were excellent in standing upright. Also, the bending recovery thereof was high enough to exhibit a high resistance to opening in an actual test. Damage to the bristle was hardly seen to indicate a high durability. In the copper plate abrasion test, the surface of the copper plate was very slightly damaged, and the sense of use was very soft. Thus, the PTT monofilament yarn was suitable for a tooth brush.

In Comparative example 1, as the boiling water shrinkage of the monofilament yarn was excessively high, deformation or kink of the bristles was seen in the resultant tooth brush, and the standing upright of the bristle was unfavorable. Also, the monofilament yarn had a low bending recovery and, therefore, bristles were largely opened in the actual use test of the tooth brush.

In Comparative example 2, as the heat treatment of the yarn was improper, the monofilament yarn had a large boiling water shrinkage, whereby the resultant tooth brush partially had a deformation or a kink of the bristles and the standing upright thereof was poor. Also, when the sterilization treatment was carried out in the boiling water during the actual use test of the tooth brush, the deformation and kink of the bristles became more significant. In the actual use test of the tooth brush, the opening of bristles was somewhat large.

In Comparative example 3, yarn breakage occurred during the heat treatment because the heat treatment temperature was too high. Since the resultant monofilament yarn is low in boiling water shrinkage and strength, there was splitting or wear of the bristles of the tooth brush in the actual use test. Also, the sense of use was somewhat hard.

In Comparative example 4, as the intrinsic viscosity of the monofilament yarn was too low, both of the strength at break and the bending recovery were also low, whereby the splitting or wear of the bristle generated during the actual use test. Also, the resistance to opening of the bristle was poor.

In Comparative example 5, as the fiber size of the monofilament yarn was too small, an absolute strength of a single monofilament yarn was insufficient and the bending recovery was low, whereby some split or wear was seen in the actual use test of the tooth brush. Also, the opening of the bristles was somewhat large.

In Comparative example 6, the N612 monofilament yarn was low in bending recovery. In the actual use test of the tooth brush, split or wear of the bristle was seen. The degree of damage to the copper plate surface was slightly large and the sense of use was hard.

CAPABILITY OF EXPLOITATION IN INDUSTRY

The inventive PTT monofilament yarn has a low Young's modulus and so is soft. When applied to a tooth brush, for example, the processability during the production is excellent. The resultant brush has a soft sense of use. Teeth and/or gums are not damaged by a tooth brush using the inventive monofilament yarn. The monofilament yarn is low in thermal shrinkage and, therefore, a tooth brush made from the monofilament yarn has a quality such that the bristle is excellent in standing upright (straightening) and is free from deformation or kink of the bristles caused by a heat treatment such as hot water sterilization. Further, as the inventive monofilament yarn has favorable toughness, stretch recovery or bending recovery, a brush made thereof is free from damage, wear or opening of the bristles and thus excellent in durability.

The inventive PTT monofilament yarn is useful for bristles of a brush including a tooth brush, a cosmetic brush, a hair brush and various industrial brushes. Also, it is useful for a fish net, a fish line, artificial turf, a zip fastener, a magic fastener, a tennis gut, a musical instrumental string, a connecting yarn for a three-dimensional fabric, a woven or knit fabric for a chair cover, a paper-making canvas, a paper-making net, a screen, a filter, a belt, an industrial sewing thread or a rope.

What we claimed is:

1. A polytrimethylene terephthalate monofilament yarn constituted by PTT composed of 90 mol % or more of trimethylene terephthalate repeating units and 10 mol % or less of other ester repeating units, wherein the yarn has a single-fiber size of 50 dtex or more, an intrinsic viscosity in a range from 0.8 to 1.3 dl/g, and a boiling water shrinkage of 2% or less.

2. A polytrimethylene terephthalate monofilament yarn as defined by claim 1, wherein the boiling water shrinkage is in a range from 0 to 1.5%.

3. A polytrimethylene terephthalate monofilament yarn as defined by claim 1 or 2, wherein a peak temperature of a mechanical loss tangent is in a range from 100 to 120° C.

4. A polytrimethylene terephthalate monofilament yarn as defined by any one of claims 1 to 3, wherein the yarn contains particles, in a range from 0.01 to 5 wt %, which have an average diameter in a range from 0.01 to 5 $\mu$m.

5. A brush filled with bristles of the polytrimethylene terephthalate monofilament yarn defined by any one of claims 1 to 4.

6. A method for producing a polytrimethylene terephthalate monofilament yarn, wherein after a raw material polytrimethylene terephthalate monofilament yarn having a fiber size of 50 dtex or more is spun and drawn, the raw material polytrimethylene terephthalate monofilament yarn is subjected to a relaxation heat treatment under the condition of a relaxation ratio in a range from −10 to +15% and a heat treatment temperature in a range from 100 to 180° C.

7. A method for producing a polytrimethylene terephthalate monofilament yarn as defined by claim 6, wherein the relaxation ratio is in a range from 1 to 15%.

* * * * *